United States Patent [19]

Jarnuszkiewicz

[11] 4,033,302

[45] July 5, 1977

[54] FOUR-STROKE, MULTICYLINDER, SPARK IGNITION, FUEL INJECTION INTERNAL COMBUSTION ENGINE

[75] Inventor: Stanislaw Jarnuszkiewicz, Krakow, Poland

[73] Assignee: Politechnika Krakowska, Krakow, Poland

[22] Filed: June 17, 1975

[21] Appl. No.: 587,621

[30] Foreign Application Priority Data

June 18, 1974 Poland ..... 172037

[52] U.S. Cl. ..... 123/59 BM; 123/33 R; 123/59 A

[51] Int. Cl.[2] ..... F02B 75/20

[58] Field of Search ..... 123/33 R, 60, 59 BM, 123/33 L, 59 EL, 33 B, 59 R, 59 A, 52 R, 139 AJ

[56] References Cited

UNITED STATES PATENTS

| | | | |
|---|---|---|---|
| 1,314,561 | 9/1919 | Wright | 123/59 A |
| 1,830,197 | 11/1931 | Felbeck | 123/60 |
| 1,921,510 | 8/1933 | De Wasmundt | 123/59 B |
| 3,800,763 | 4/1974 | Pouit | 123/59 BM |

*Primary Examiner*—Carroll B. Dority, Jr.
*Assistant Examiner*—David D. Reynolds

[57] ABSTRACT

A four-stroke multicylinder internal combustion engine having first and second cylinders in which combustion takes place in alternation in the cylinders at intervals of 360° of crankshaft revolution. A duct connects the working spaces of the cylinders for flow of exhaust gases between the cylinders and a fuel line is connected to the duct for supplying fuel thereto so that the fuel is transported with the flow of exhaust gases from one cylinder to the other.

8 Claims, 1 Drawing Figure

Figure 1:
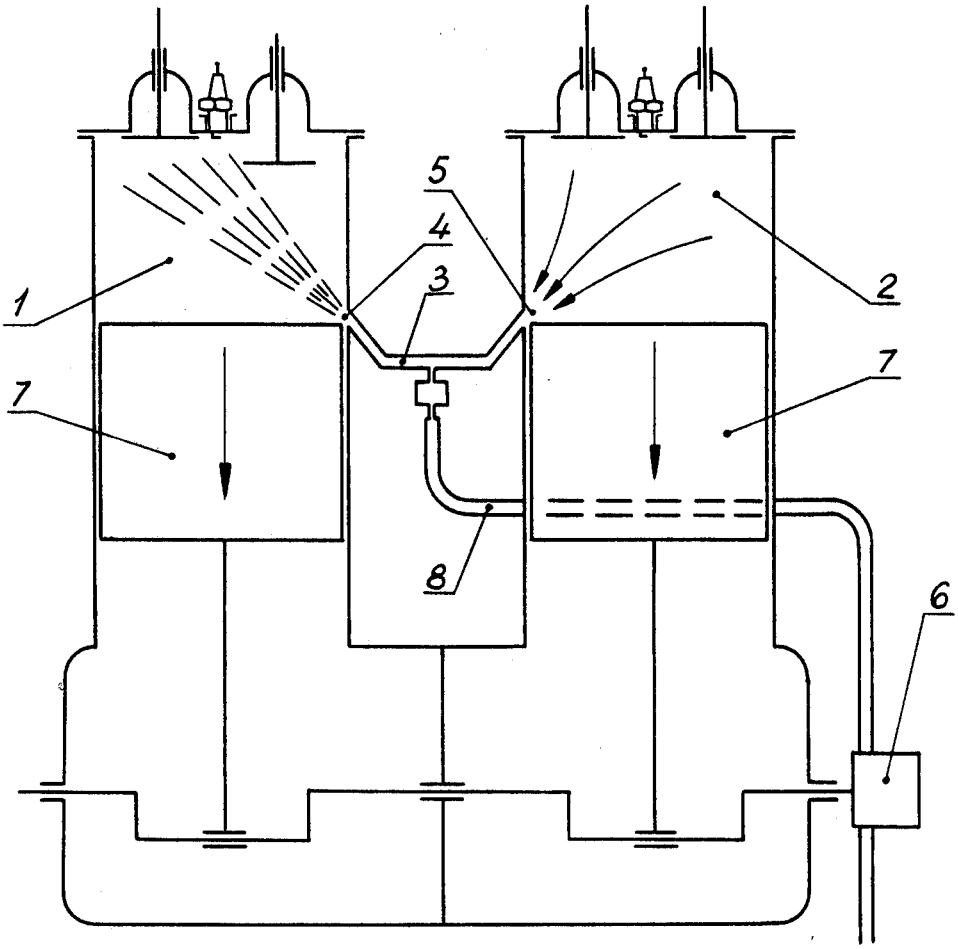

FOUR-STROKE, MULTICYLINDER, SPARK IGNITION, FUEL INJECTION INTERNAL COMBUSTION ENGINE

This invention relates to a four-stroke, multicylinder, spark ignition, internal combustion engine whereby fuel is injected into the cylinder by means of combustion gases and no fuel injection pump is employed.

In the previously proposed two-stroke, multicylinder, spark ignition, pumpless injection internal combustion engine, the working spaces of cylinders are interconnected by means of gas ducts, the fuel being injected at a controlled rate to the working spaces of cylinders by means of combustion gases. The inlet-injection ports of said gas ducts are situated in the cylinder wall at a predetermined distance from the top dead center of the piston.

An object of the present invention is to employ fuel injection in four-stroke engines by means of the pressure of the combustion gases in the cylinders.

In accordance with the principle of the present invention, the working spaces in a four-stroke engine are interconnected between those two cylinders in which the ignition takes place in alternation at intervals of 360° of crankshaft revolution, namely in cylinders in which the pistons are moving in unison. The duct interconnecting the working spaces of these two cylinders includes in both cylinders inlet-injection ports situated at the same level so that the edges of the moving pistons cover and uncover these ports. Since the ignition in both cylinders follows in sequence every 360° of crankshaft revolution, there is a difference of pressure at both ends of the duct and, after the ports are uncovered, the gas flows from the cylinder in which the ignition took place to the cylinder in which the ignition is about to take place. Since the fuel is delivered to the gas duct at a controlled rate, the flowing gas picks this fuel up injecting it to the working space of a cylinder in which the pressure is lower.

The system of the invention of a fuel injection can be accomplished in four-stroke engines having an even number of cylinders, namely in 2, 4, 6, 8 and more cylinder engines, by interconnecting the working spaces of cylinders in which the ignition takes place in alternation every 360° of crankshaft revolution.

The engine of the invention in the form of a two-cylinder version in which the pistons are moving in unison and the ignition takes place in alternation every 360° of crankshaft revolution is illustrated in the accompanying drawing in which FIG. 1 illustrates the engine in longitudinal section.

Working spaces of cylinders 1 and 2 are interconnected by means of gas duct 3, inlet-injection ports 4 and 5 of the said duct being situated in the cylinder walls at the same level. The fuel is delivered to the duct 3 at a controlled rate from a fuel pump 6 which may be of variable delivery. At the moment at which the edges of pistons 7 uncover the inlet-injection ports 4 and 5 of gas duct 3, the combustion gases from cylinder 2, in which the ignition took place, flow through the duct 3 to the working space of cylinder 1, picking up on their way the fuel delivered at a controlled rate through a fuel line 8.

Since an induction stroke takes place at this moment in the cylinder 1 and there is a low pressure in the said cylinder, the fuel is injected in the direction of combustion chamber. After the crankshaft turns by 360°, the combustion gases begin to flow through the duct 3 in the opposite direction, namely from cylinder 1 to cylinder 2 thus causing that fuel is injected to the working space of cylinder 2.

What I claim is:

1. In a four-stroke multicylinder internal combustion engine having first and second cylinders defining working space, inlet and outlet valves in said cylinders at the upper ends thereof and respective pistons moving in unison in the cylinders and wherein combustion takes place in alternation in the cylinders at intervals of 360° of crankshaft revolution, the improvement comprising valveless duct means interconnecting the working spaces of the cylinders for flow of exhaust gases between the cylinders, and means for supplying fuel to said duct means such that the fuel is transported with the flow of exhaust gases from one cylinder to the other.

2. The improvement as claimed in claim 1 wherein said duct means includes inlet-injection ports connected to respective cylinders.

3. The improvement as claimed in claim 2 wherein said ports are located in said respective cylinders at the same level.

4. The improvement as claimed in claim 1 wherein said means for supplying fuel to said duct means comprises means for delivering fuel at a controlled rate.

5. The improvement as claimed in claim 1 wherein said means for supplying fuel to said duct means comprises a fuel pump of variable delivery drivingly coupled to the engine.

6. The improvement as claimed in claim 1 wherein said duct means has opposite ends and includes upwardly inclined branches at said ends.

7. The improvement as claimed in claim 6 wherein the duct means further includes a central horizontal portion to which said means for supplying fuel is connected.

8. A method for injection of fuel into a multicylinder, four-stroke, internal combustion engine in which the working spaces of two cylinders are interconnected and respective pistons moving in unison in the cylinders and wherein combustion takes place in the cylinders in alternation at intervals of 360° and exhaust gases flow from one cylinder to the other via a valveless connecting duct, said method comprising feeding fuel to the exhaust gases in said duct flowing from one cylinder to the other for transport therewith, and injecting the fuel and exhaust gas mixture into said other cylinder.

* * * * *